US006994490B2

(12) United States Patent
Maestro

(10) Patent No.: US 6,994,490 B2
(45) **Date of Patent: *Feb. 7, 2006**

(54) STORMWATER RECEIVING DEVICE AND ASSEMBLY

(76) Inventor: Robert M. Maestro, 12301 Beechnut Ct., Woodbridge, VA (US) 22192-2002

( * ) Notice: Subject to any disclaimer, the term of this patent is extended or adjusted under 35 U.S.C. 154(b) by 114 days.

This patent is subject to a terminal disclaimer.

(21) Appl. No.: 10/820,923

(22) Filed: Apr. 8, 2004

(65) Prior Publication Data

US 2005/0100410 A1 May 12, 2005

Related U.S. Application Data

(63) Continuation-in-part of application No. 10/330,595, filed on Dec. 30, 2002, now Pat. No. 6,719,490.

(51) Int. Cl.
*E02B 11/00* (2006.01)
*E02B 13/00* (2006.01)

(52) U.S. Cl. ..... 405/46; 405/49; 405/43

(58) Field of Classification Search ..... 405/36, 405/39–49, 51
See application file for complete search history.

(56) References Cited

U.S. PATENT DOCUMENTS 6,719,490 B2 * 4/2004 Maestro ..... 405/46

* cited by examiner

*Primary Examiner*—Frederick L. Lagman
(74) *Attorney, Agent, or Firm*—Norman B. Rainer

(57) ABSTRACT

A sediment accumulating device for use as an accessory disposed below a groundwater receiving chamber engulfed in granular backfill material has a compartment bounded by sidewall structure elongated upon a vertical axis between upper and lower extremities. The upper extremity is open and has a perimeter disposed in a plane orthogonal to the axis. The bottom extremity is closed. Retaining means protrude radially outward from the sidewall structure for receiving downward gravity force from the granular material.

8 Claims, 4 Drawing Sheets

STORMWATER RECEIVING DEVICE AND ASSEMBLY

RELATED APPLICATIONS

This Application is a Continuation-in-Part of U.S. patent application Ser. No. 10/330,595, filed Dec. 30, 2002 now U.S. Pat. No. 6,719,490.

BACKGROUND OF THE INVENTION

1. Field of the Invention

The present invention relates to the management of stormwater runoff, and more particularly concerns devices which minimize and facilitate sediment maintenance, expand the storage capacity of stormwater management systems, and facilitate the infiltration of stormwater into the surrounding substrate.

2. Description of the Prior Art

Culverts, catch basins, and storm sewers are the common practices for collecting and conveying stormwater runoff. In some instances such water is discharged directly into the nearest available water body despite the potentially adverse environmental effects of such action. In some other instances, stormwater management facilities are constructed to help manage the quantity and quality of the stormwater. Wet or dry retention or detention basins/ponds represent the most common structural approach to stormwater management. Although more environmentally sound than direct discharge into an existing body of water, such stormwater management approaches preclude other uses of the land. This is of particular importance where land values are high and/or space is limited. The open ponds may also be undesirable in locations near airports because of birds attracted by the pond, or in locations where health, liability or aesthetic considerations make them undesirable. Even the use of "dry" detention basins frequently results in the same type of problems associated with wet ponds. Without proper maintenance, dry detention basins frequently transform into wet ponds.

Underground systems have also been developed to help manage stormwater effluent. Such systems include the use of plastic arch-shaped, open bottom stormwater chambers arranged end-to-end in rows. However, all current underground stormwater management systems are limited by the amount of area available for their installation. This is particularly relevant to the plastic stormwater chambers. The largest plastic chamber currently on the market has an arched cross-sectional area of 34 inches high by 60 inches wide and a length of eight and one half feet. The creation of larger chambers is limited by the forming capacity of molding machinery.

In a typical installation of plastic stormwater chambers, elongated hollow plastic chambers are emplaced in the ground to form a leaching field for receiving stormwater and dispensing the water into the surrounding earth. Such chambers have a central cavity for receiving inflow water. An open bottom, and apertures optionally located in the sides of the chambers provide the means whereby the water is allowed to exit the central cavity and disperse into the surrounding earth. The chambers are usually attached endwise to form long rows extending in side-by-side juxtaposition and seated upon a granular substrate such as crushed rock in a multi-row array that constitutes a leaching field. The stormwater is generally conducted to the array of rows by a large diameter manifolded pipe system that runs orthogonally to the rows closely adjacent one extremity thereof.

Examples of stormwater dispensing chambers are disclosed in U.S. Pat. Nos. 5,017,041; 5,156,488; 5,336,017; 5,401,116; 5,441,363; 5,556,231 and 6,361,248.

Stormwater typically carries considerable amounts of suspended particulate material, commonly referred to as Total Suspended Solids (TSS), which eventually settles out as sediment within the stormwater management system. The accumulation of such sediment adversely affects the storage capacity of stormwater management facilities, decreasing their effective life. The effective life of such facilities can be significantly extended with a maintenance program for sediment removal. Such sediment removal can generally be achieved by a vacuuming operation conducted by a suitably equipped truck. In such operation, a tube is extended from the truck through a manhole, through an associated riser pipe, and into the bottom of the chamber. The sediment in the bottom of the chamber is then removed by vacuuming.

Unfortunately, the maintenance of stormwater management systems is often neglected, and typically occurs only when the system fails or sediment accumulates to a point where flooding occurs because of diminished storage capacity of the system. This problem has become so serious that some municipalities have imposed a stormwater maintenance "fee" on property owners to help pay for private-sector stormwater facility maintenance.

Unlike stormwater wet and dry ponds, which are readily observable and accessible, removal of sediment from underground stormwater management facilities has historically been inherently more inconvenient and costly, resulting in resistance to their use by some municipalities. Some types of underground stormwater management facilities even have to be replaced in order to remove accumulated sediment.

patent application Ser. No. 10/330,595, filed Dec. 30, 2002 by the same inventor discloses a sediment-accumulating accessory device which, when deployed beneath a plastic chamber having a top portal, facilitates the accumulation and removal of TSS. It has been found, however, that the installation of such accessory devices is difficult because they tend to be buoyed upwardly when the granular backfill material is poured into surrounding relationship with the accumulating device and associated chamber.

It is accordingly an object of the present invention to improve the sediment handling capacity of an underground stormwater management system.

It is another object of this invention to provide an accumulating accessory device interactive with a plastic stormwater dispensing chamber to increase the sediment handling capacity of an underground stormwater management system comprised of said chambers.

It is a further object of the present invention to provide a plastic stormwater dispensing chamber combined with an accumulating accessory in a manner to facilitate removal of accumulated sediment.

It is yet another object of this invention to provide an accumulating device of the aforesaid nature which resists buoyant upward movement produced by granular backfill material.

It is an additional object of the present invention to provide a combined stormwater dispensing chamber and accumulating accessory of the aforesaid nature of durable, simple construction amenable to low cost fabrication and installation.

These objects and other objects and advantages of the invention will be apparent from the following description.

SUMMARY OF THE INVENTION

The above and other beneficial objects and advantages are accomplished in accordance with the present invention by a stormwater receiving assembly comprised of an accumulating device interactive with a stormwater dispensing chamber comprised of a plastic wall elongated between inlet and exit ends and having an arched cross-sectional shape with upwardly directed peak and spaced apart parallel lowermost edge extremities defining an open bottom, said wall having clean out portal means in said peak.

The accumulating device is comprised of a compartment bounded by sidewall structure elongated upon a vertical axis between upper and lower extremities, said upper extremity being open and having a perimeter disposed in a plane orthogonal to said axis. The improved accumulating device of this invention has retaining means protruding outwardly from said sidewall structure for receiving downward gravity force from granular backfill material. The retaining means may be attached to or integral with said sidewall structure and may have the form of shelves, pockets or flanges directed radially outward from the sidewall structure.

The accumulating device is operatively positioned below said dispensing chamber in a manner such that the clean out portal means of the chamber is in centered vertical alignment with the lower extremity of said compartment.

In preferred embodiments, the sidewall structure of the compartment of the accumulating device is downwardly convergent toward its lower extremity which is closed by way of a bottom panel. The sidewall structure may be fabricated of four flat panels joined in an inverted pyramidal configuration having a rectangular upper extremity. Alternatively, the sidewall structure may be of cylindrical or conical configuration, fabricated of plastic by way of a molding operation. Said sidewall may have apertures to permit water drainage. The size and configuration of said upper extremity may be such as to support the edge extremities of the overlying chamber.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
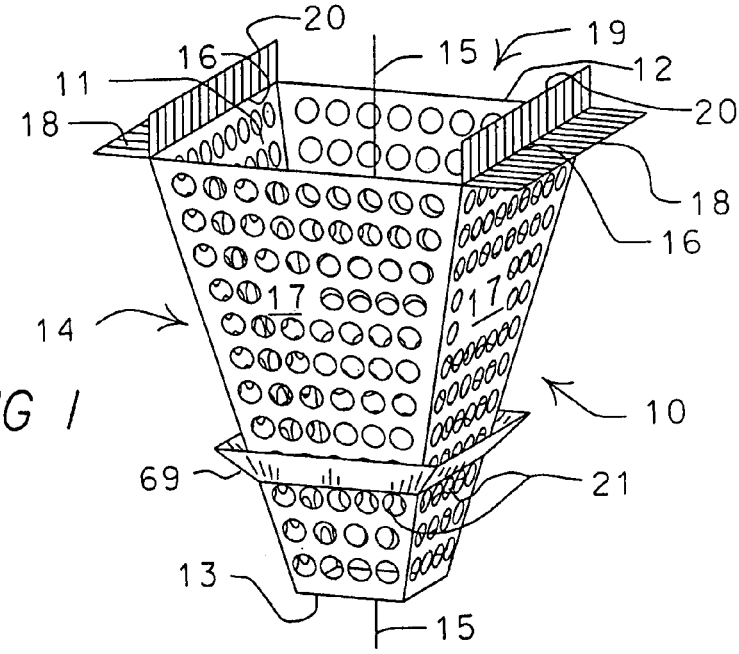
FIG. 1 is a top and side perspective view of an embodiment of the accumulating device of the present invention.
Figure 2:
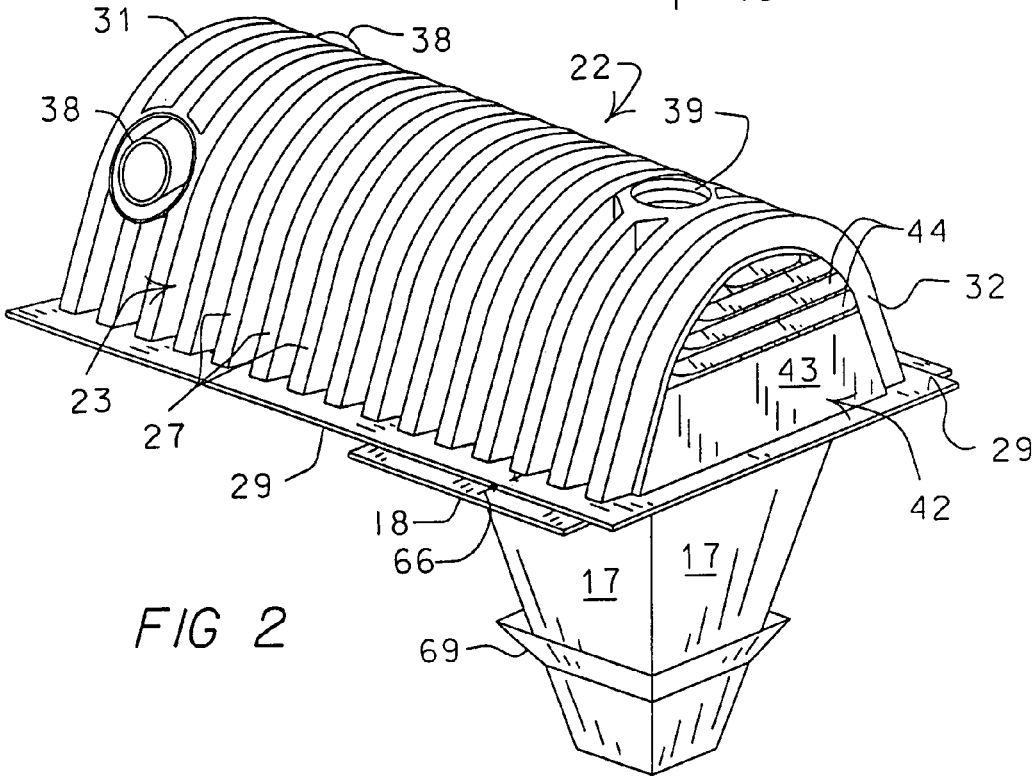
FIG. 2 is a top and side perspective view of a stormwater receiving assembly employing the accumulating device of FIG. 1.

Referring now to FIG. 2, an embodiment of stormwater receiving assembly is shown comprised of receiving chamber 22 and an accumulating device 10 positioned below said chamber. The accumulating device exemplified in FIG. 2, as best illustrated in FIG. 1, is shown as a monolithic structure fabricated of polyethylene, polypropylene or equivalent thermoplastic polymer and having a substantially uniform thickness throughout of between 2 and 10 mm. The accumulating device is comprised of a compartment 11 having an open upper extremity 12 and closed lower extremity 13. Said compartment is further defined by sidewall structure 14 which, at least in part, is preferably downwardly convergent upon center vertical axis 15. The degree of convergence is such that the cross-sectional area of the lower extremity, taken in a plane orthogonal to said axis is 10% to 40% of the cross-sectional area of said open upper extremity. The height of the accumulating device, measured between said upper and lower extremities is preferably between 20 and 72 inches. In alternative embodiments, the sidewall structure may be comprised of an upper portion 77 of non-convergent configuration, such as cylindrical or rectangular shape, and a lower portion 78 of convergent configuration. Said upper and lower portions may be interconnected separate pieces, or may be integral portions of a monolithic molded structure.

In the embodiment of FIGS. 1–4, said sidewall structure is comprised of four flat panels 17 disposed in an inverted pyramidal configuration, causing upper extremity 12 to have a rectangular perimeter 19 defined by straight edges 16. Flat apron panels 18, emergent from opposed straight edges 16, are directed outwardly from said compartment within the plane of perimeter 19. Alignment means in the form of paired retaining lips 20 are emergent from said apron panels and directed upwardly from said compartment. Said retaining lips engage the interior surface of the associated chamber 22 adjacent its lowermost edge 25, thereby stabilizing the interaction of the chamber with the underlying accumulating device and further serving to achieve lateral alignment of said device with associated chamber 22. Additional alignment means, which may be in the form of indicia 66 on apron panels 18 and chamber 22, facilitate axial alignment of chamber 22 with respect to accumulating device 10. Sidewall structure 14 may be provided with a multitude of apertures 21 which facilitate drainage of water from said compartment. The diameter of the apertures may range from ⅛" to 1". The total area of said apertures preferably occupies between 1% and 10% of the total area of sidewall structure 14.

Retaining means 68 extend outwardly from said sidewall structure, namely in a direction away from axis 15. Said retaining means are configured to supportively receive the surrounding granular back fill material, thereby enabling the weight of said material to force the accumulating device downward. Such downward force overcomes the buoyant force otherwise produced by the backfill material, which tends to push the accumulating device upward.

Figure 3:
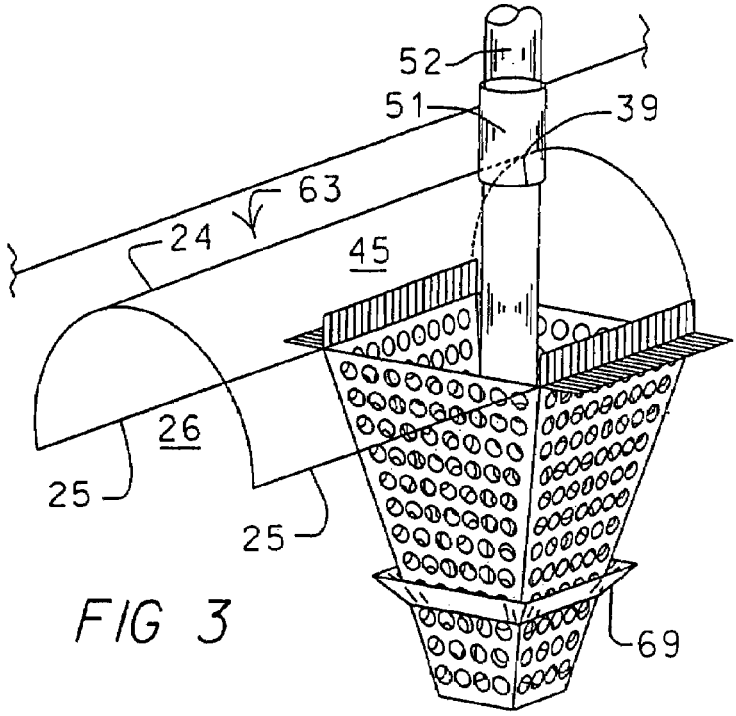
FIG. 3 is a schematic top and side perspective view of the assembly of FIG. 2 shown in functional association with a suction tube that removes accumulated sediment.
Figure 4:
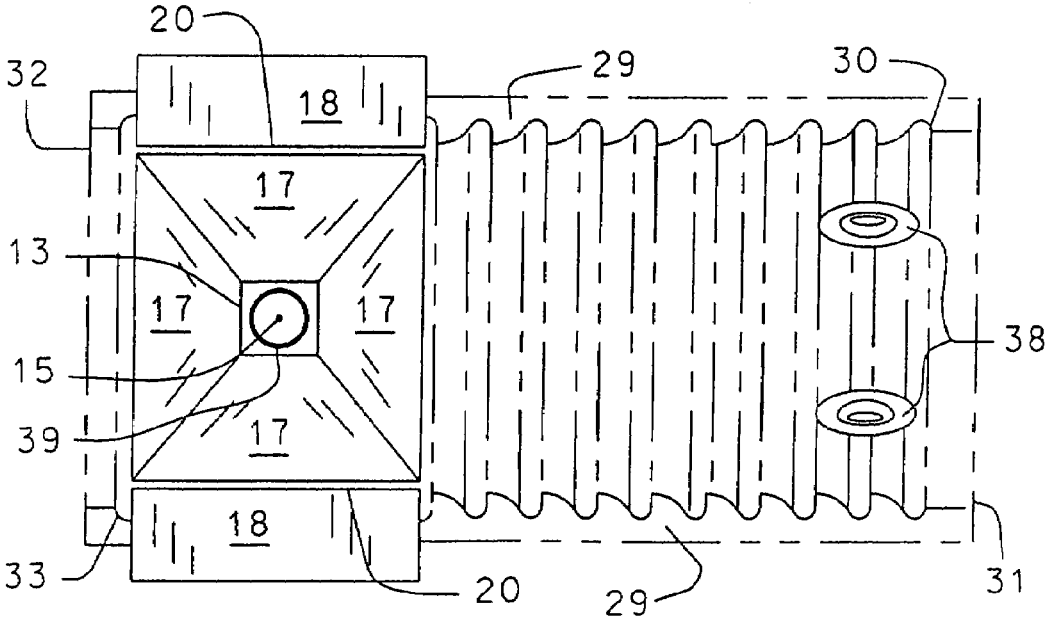
FIG. 4 is a top view of the assembly of FIG. 2 with the chamber component shown in phantom outline so as to reveal underlying features.

In the embodiment shown in FIGS. 1–3, the retaining means are exemplified as trough or pocket-shaped structures 69 attached to the sidewall structure in symmetrical disposition thereabout. Each of the four panels of the sidewall structure are shown having one continuous length of pocket structure 69. In related embodiments, second or third similar pockets may be spaced upwardly on the panels. In other embodiments, the pockets may be separate, discontinuous units. Regardless of the number or configuration of said retaining means, it is preferred that they be disposed in a gravimetrically symmetrical manner with respect to axis 15, namely disposed in a manner which will not produce tilting of axis 15.

FIGS. 2–5 illustrate the manner in which the accumulating device 10 is combined with a stormwater dispensing chamber 22 for the purpose of increasing the amount of sediment that the chamber can hold, and also for facilitating the removal of such sediment from the chambers. Chamber 22 is comprised of a wall 23 extending upon a longitudinal axis between inlet and exit ends, 31 and 32, respectively, and having an arch shape cross-section with an upwardly directed peak 24, and opposed lowermost spaced apart parallel edges 25 which define an open bottom 26. Wall 23 has a multiplicity of corrugations 27 disposed in planes orthogonal to edges 25, thereby causing said wall to have increased compressive strength.

Chambers useful in the practice of the present invention are fabricated preferably of polypropylene or high density polyethylene by way of thermal vacuum forming or gas assisted injection molding techniques, generally in accord with the technology described in U.S. Pat. Nos. 5,401,459; 5,087,151; 4,247,515; 4,234,642; 4,136,220 and 4,101,617. During molding, the plastic is configured to form a chamber having outwardly directed hollow ribs or corrugations 27. The disclosures of the foregoing patents are hereby incorporated by reference.

The chamber preferably has opposed axially elongated base panels 29 integral with said edges 25 of wall 23. Said base panels support the chamber, discouraging its descent into the underlying substrate.

The terminal or first rib or corrugation 30 adjacent inlet end 31 may be slightly larger than the multitude of ribs, and terminal rib 33 adjacent exit end 32 is slightly smaller than the multitude of ribs. Such configuration of the terminal ribs facilitates end-to-end joinder of successive chambers wherein vertical lowering of a chamber automatically causes the larger rib of one chamber to embrace the smaller rib of the next successive chamber.

Typical chambers of this invention may have a length of 6–12 feet measured between inlet and exit ends and a height up to 50 inches. The width of the chamber, measured between said opposed base panel 29, may range to 80 inches, including the width of said base panels.

Side inlet portal means 38 may be disposed in wall 23 for the purpose of accommodating horizontally disposed conduits that deliver stormwater to the chamber. Top portal means 39 is disposed in the peak of wall 23 adjacent exit end 32. Said top portal means is either a circular aperture or an indented portion of the wall which facilitates the cutting of a circular aperture. This permits visual observation of sediment level and removal thereof by vacuum equipment. The expression "adjacent exit end 32" is intended to denote a site along the horizontal length of the chamber which is within 20%, and preferably within 10% of the distance going from said exit end toward the opposed inlet end. The diameter of said portal means is preferably less than the diameter of the closed lower extremity 13 of said compartment.

The exit end 32 of the chamber may be provided with flow impeding means in the form of transverse panel 42, as best shown in FIG. 2, having a lower impervious portion 43 and an apertured upper portion 44. Said transverse panel functions to reduce the velocity of water flow, thereby causing sediment to accumulate in the area of exit end 32 of the chamber, and directly below top portal means 39.

Accumulating device 10 is intended to be functionally associated with a stormwater dispensing chamber as shown in FIGS. 2–5, wherein said chamber is positioned atop the accumulating device. It is to be further noted that the device is positioned such that its vertical axis 15 intersects the center of top portal means 39.

Figure 5:
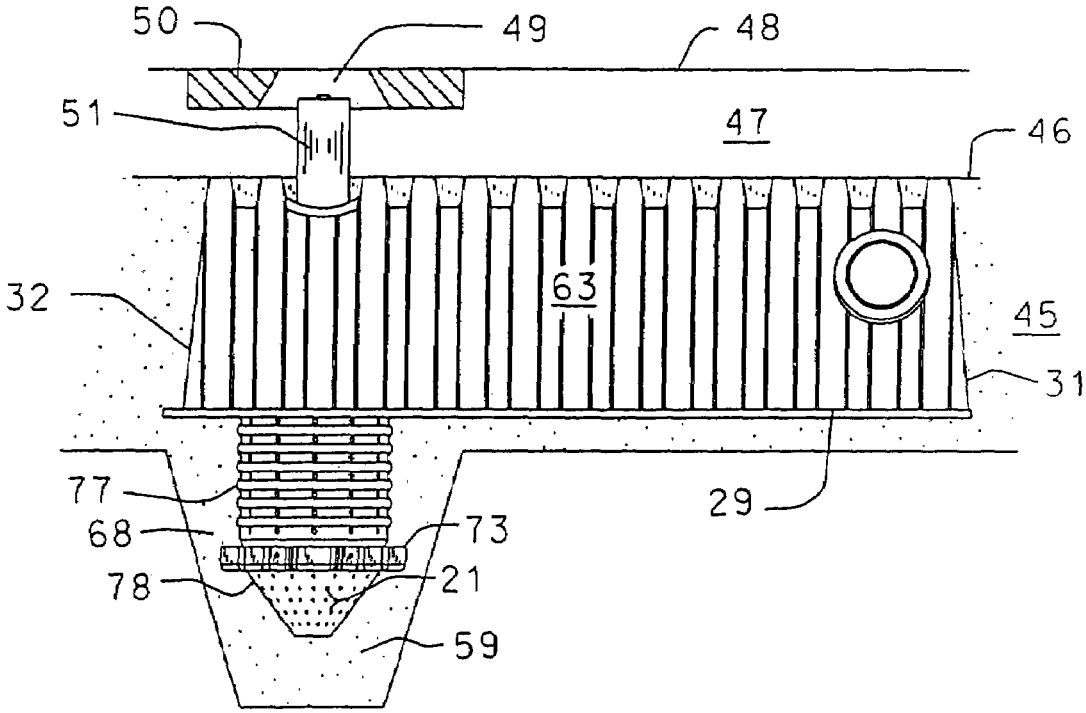
FIG. 5 is a side view of a first alternative embodiment of the accumulating device of this invention shown in schematic functional association with components of a stormwater leaching field.

As shown in FIGS. 3 and 5, the combined chamber and accumulating device of this invention is installed in an excavation and engulfed by granular material such as gravel or crushed rock 45 that extends to the top of the chamber. A filter fabric 46 may be disposed atop the granular substrate. A zone of compacted clean fill, gravel or crushed stone 47 extends from filter fabric 46 to an overlying layer such as pavement 48. A manhole 49 may be disposed in a concrete pad 50 centered above top portal means 39. A riser conduit 51 communicates between said manhole and top portal means. Accumulated sediment is removed from the chamber by causing a suction tube 52 to pass through conduit 51 to the bottom of the accumulating device. A vacuuming operation then transports the sediment upwardly into a servicing truck.

The first alternative embodiment of accumulating device 10, exemplified in FIG. 5, has an upper sidewall structure 77 in the form of a corrugated perforated pipe of substantially cylindrical contour. The lower portion 78 of the sidewall structure has a conical configuration with a multitude of apertures 21. Retaining means in the form of annular shelf 73 is disposed at the juncture of the upper and lower portions of the sidewall structure. Said shelf may protrude outwardly about 3 to 9 inches.

Figure 6:
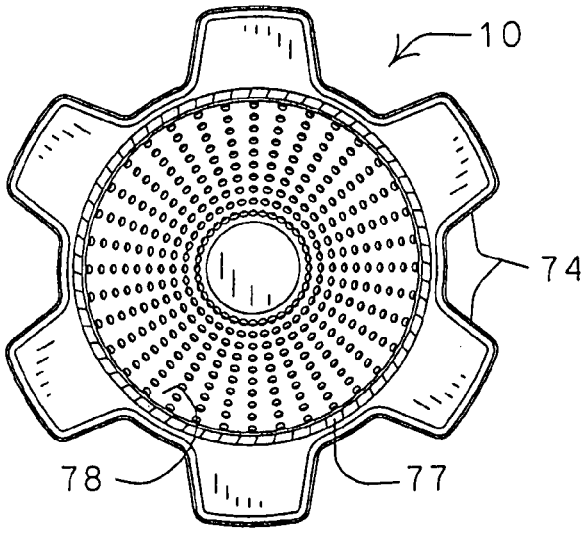
FIG. 6 is a top view of a second alternative embodiment of the accumulating device.
Figure 7:
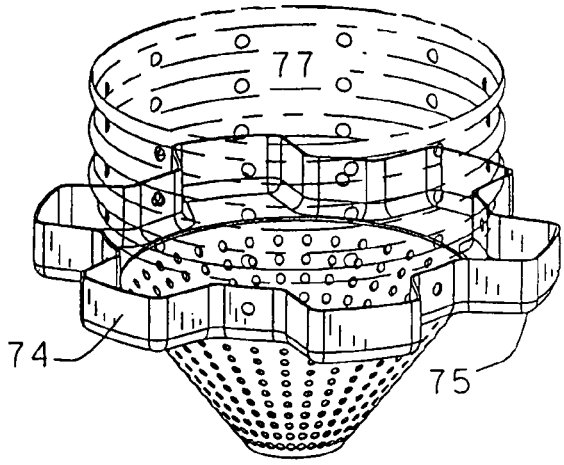
FIG. 7 is a fragmentary top perspective view of the embodiment of FIG. 6.
Figure 8:
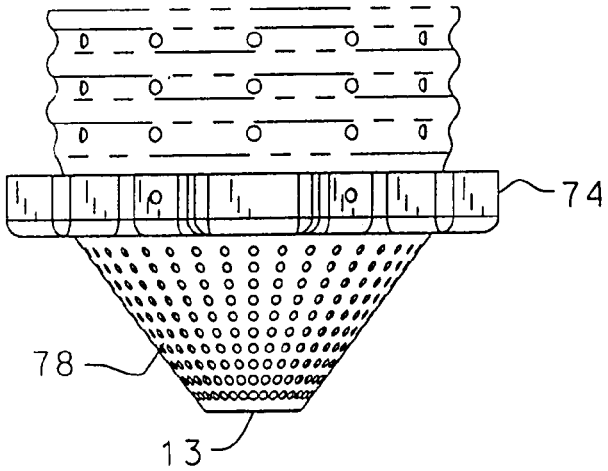
FIG. 8 is a fragmentary side view of the embodiment of FIG. 6.

The second alternative embodiment of accumulating device 10, shown in FIGS. 6–8, is similar to the embodiment in FIG. 5, with the exception that the retaining means is now a series of radially oriented pockets 74 disposed as an annular array about the juncture of the upper and lower portions of the sidewall structure, said upper portion being shown in fragmentary phantom view. Said array of pockets is a single shaped structure 75 which is bolted or otherwise attached to the sidewall structure.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. A device for accumulating suspended matter from stormwater confined within a chamber engulfed by granular backfill material, comprising a compartment bounded by sidewall structure elongated upon a vertical axis between upper and lower extremities, said upper extremity being open and having a perimeter disposed in a plane orthogonal to said axis, and retaining means protruding outwardly from said sidewall structure for receiving downward gravity force from said granular material.

2. The device of claim 1 wherein said sidewall structure is downwardly convergent upon said vertical axis.

3. The device of claim 2 wherein the degree of convergence of said sidewall structure is such that the cross-sectional area of said lower extremity is 10% to 40% of the cross-sectional area of said upper extremity.

4. The device of claim 3 wherein the lower extremity of said compartment is closed.

5. The device of claim 1 wherein said sidewall structure has a multitude of apertures which facilitate drainage of water from said compartment.

6. The device of claim 5 wherein the total area of said apertures is between 1% and 10% of the total area of said sidewall structure.

7. The device of claim 1 wherein said retaining means are disposed in a gravimetrically symmetrical manner with respect to said axis.

8. An assembly comprising the device of claim 1 and a stormwater receiving chamber having an open bottom and a top portal, said device being positioned below said open bottom in axial alignment with said portal.

* * * * *